US010370932B2

(12) United States Patent
Rouchon et al.

(10) Patent No.: US 10,370,932 B2
(45) Date of Patent: Aug. 6, 2019

(54) SYSTEMS AND METHODS FOR RETRACTION ASSEMBLY

(71) Applicant: Schlumberger Technology Corporation, Sugar Land, TX (US)

(72) Inventors: Lambert Rouchon, Abbeville (FR); Pierre-Yves Corre, Abbeville (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/763,641

(22) PCT Filed: Sep. 30, 2016

(86) PCT No.: PCT/US2016/054578
§ 371 (c)(1),
(2) Date: Mar. 27, 2018

(87) PCT Pub. No.: WO2017/059154
PCT Pub. Date: Apr. 6, 2017

(65) Prior Publication Data

US 2018/0274324 A1 Sep. 27, 2018

(30) Foreign Application Priority Data

Sep. 30, 2015 (EP) ..... 15290249

(51) Int. Cl.
*E21B 33/127* (2006.01)
*E21B 33/124* (2006.01)

(52) U.S. Cl.
CPC ..... *E21B 33/127* (2013.01); *E21B 33/1243* (2013.01)

(58) Field of Classification Search
CPC ..... E21B 33/1243; E21B 33/127
See application file for complete search history.

(56) References Cited

U.S. PATENT DOCUMENTS

| | | | |
|---|---|---|---|
| 3,392,785 | A | 7/1968 | King |
| 7,231,987 | B2 | 6/2007 | Kilgore et al. |
| 7,578,342 | B2 | 8/2009 | Brennan, III et al. |
| 7,762,325 | B2 | 7/2010 | Ellson et al. |
| 8,020,294 | B2 | 9/2011 | Pessin et al. |
| 8,695,717 | B2 | 4/2014 | Brennan, III et al. |
| 2005/0205269 | A1 | 9/2005 | Kilgore et al. |
| 2007/0056749 | A1 | 3/2007 | Gambier et al. |
| 2009/0283279 | A1 | 11/2009 | Patel et al. |
| 2010/0051259 | A1 | 3/2010 | Pessin et al. |

OTHER PUBLICATIONS

International Search Report and Written Opinion issued in the related PCT application PCT/US2016/054578, dated Dec. 27, 2016 (8 pages).
Extended Search Report issued in the related EP Application 16852652.3, dated Apr. 2, 2019 (7 pages).

*Primary Examiner* — Kristyn A Hall
(74) *Attorney, Agent, or Firm* — Michael Dae

(57) ABSTRACT

The present disclosure relates to a downhole packer assembly that includes an outer skin, an inner packer disposed within the outer skin such that inflation of the inner packer is configured to expand the outer skin, an end support coupled to an outer skin end and an inner packer end, a retraction assembly coupled to the end support via a plurality of connecting members, and a plurality of chambers disposed within the retraction assembly. The plurality of connecting members are at least partially disposed within the plurality of chambers.

14 Claims, 3 Drawing Sheets

SYSTEMS AND METHODS FOR RETRACTION ASSEMBLY

BACKGROUND OF THE DISCLOSURE

Wellbores or boreholes may be drilled to, for example, locate and produce hydrocarbons. During a drilling operation, it may be desirable to evaluate and/or measure properties of encountered formations and formation fluids. In some cases, a drillstring is removed and a wireline tool deployed into the borehole to test, evaluate and/or sample the formations and/or formation fluid(s). In other cases, the drillstring may be provided with devices to test and/or sample the surrounding formations and/or formation fluid(s) without having to remove the drillstring from the borehole.

Formation evaluation may involve drawing fluid from the formation into a downhole tool for testing and/or sampling. Various devices, such as probes and/or packers, may be extended from the downhole tool to isolate a region of the wellbore wall, and thereby establish fluid communication with the subterranean formation surrounding the wellbore. Fluid may then be drawn into the downhole tool using the probe and/or packer. Within the downhole tool, the fluid may be directed to one or more fluid analyzers and sensors that may be employed to detect properties of the fluid while the downhole tool is stationary within the wellbore.

SUMMARY

The present disclosure relates to a downhole packer assembly that includes an outer skin, an inner packer disposed within the outer skin such that inflation of the inner packer is configured to expand the outer skin, an end support coupled to an outer skin end and an inner packer end, a retraction assembly coupled to the end support via a plurality of connecting members, and a plurality of chambers disposed within the retraction assembly. The plurality of connecting members are at least partially disposed within the plurality of chambers.

The present disclosure also relates to a retraction assembly for a downhole packer assembly that includes a ring comprising a plurality of chambers formed within the ring and a plurality of connecting members. First ends of the plurality of connecting members are at least partially disposed within the plurality of chambers, and second ends of the plurality of connecting members are configured to couple to an end support of the downhole packer assembly.

The present disclosure also relates to a method that includes providing a packer assembly having an inner packer disposed within an outer skin. An end support is coupled to an outer skin end and an inner packer end, a retraction assembly is coupled to the end support via a plurality of connecting members, and a plurality of chambers are disposed within the retraction assembly. The plurality of connecting members are at least partially disposed within the plurality of chambers. The method also includes positioning the packer assembly in a wellbore and inflating the inner packer until the outer skin seals against walls of the wellbore. Inflating includes moving the end support in a first direction such that volumes of the plurality of chambers increase thereby exerting retraction forces on the plurality of connecting members. The method also includes deflating the inner packer and retracting the outer skin and the inner packer using the retraction assembly. Retracting includes moving the end support in a second direction opposite from the first direction via the retraction forces such that volumes of the plurality of chambers decrease.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
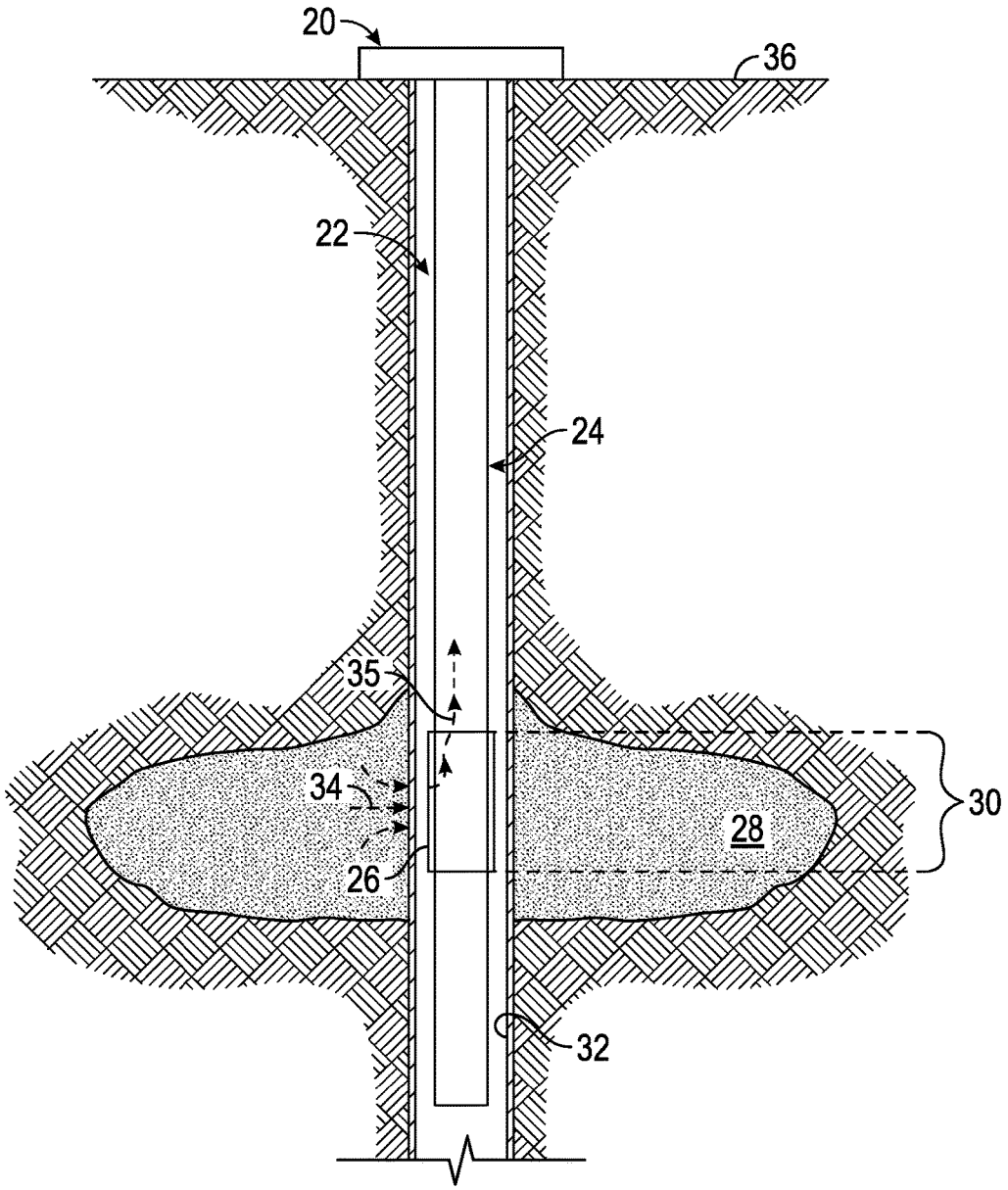
FIG. 1 is a schematic front elevation view of an embodiment of a well system having a packer assembly through which formation fluids may be collected, according to aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure relates to systems and methods for a retraction assembly that may be used with an expandable packer assembly that is part of a downhole tool disposed in a wellbore. In certain embodiments, formation fluid samples are collected through an outer layer of the packer assembly and conveyed to a desired collection location. In addition, the packer assembly may include an expandable sealing element that enables the packer assembly to better support the formation in a produced zone at which formation fluids are collected. In certain embodiments, the packer assembly expands across an expansion zone, and formation fluids can be collected from the middle of the expansion zone, i.e. between axial ends of the outer sealing layer. The formation fluid collected is directed along flowlines, e.g. along flow tubes, having sufficient inner diameter to allow operations in a variety of environments. Formation fluid can be collected through one or more drains. For example, separate drains can be disposed along the length of the packer assembly to establish collection intervals or zones that enable focused sampling at a plurality of collecting intervals, e.g. two or three collecting intervals. Separate flowlines can be connected to different drains, e.g. sampling drains and guard drains, to enable the collection of unique formation fluid samples.

In certain embodiments, the packer assembly includes several components or layers, such as an outer skin and an inner packer disposed within the outer skin such that inflation of the inner packer causes the outer skin to expand. Ends of the outer skin and the inner packer may be coupled to an end support that is coupled to the retraction assembly via a plurality of connecting members. A plurality of chambers may be disposed within the retraction assembly and the plurality of connecting members may be at least partially disposed within the plurality of chambers. When the inner packer is inflated, the end support moves in a first direction away from the retraction assembly, thereby increasing volumes of the plurality of chambers. Thus, retraction forces are exerted on the plurality of connecting members because of the increased volumes. After the inner packer is deflated, the retraction forces help move the end support in a second direction toward the retraction assembly. Thus, the retraction assembly helps to fully retract the inner packer and outer skin, thereby decreasing the outer diameter of the packer assembly and enabling the packer assembly to be safely and efficiently moved within the wellbore. In addition, embodiments of the retraction assembly may function automatically without operator involvement or other activation of valves or other equipment. In particular, the retraction forces generated by the movement of the plurality of connecting members automatically retract the outer skin and inner packer after deflation of the inner packer. Further, the retraction forces exerted by embodiments of the retraction assembly may be adjusted for different wellbore conditions by adjusting the number or area of connecting members. In addition, embodiments of the retraction assembly may be effective even at relatively high hydrostatic pressures present in the wellbore, such as, but not limited to, hydrostatic pressures greater than approximately 20 Kpsi (137,895 MPa) or 30 Kpsi (206,843 MPa).

Referring generally to FIG. 1, one embodiment of a well system 20 is illustrated as deployed in a wellbore 22. The well system 20 includes a conveyance 24 employed to deliver at least one packer assembly 26 downhole. In many applications, the packer assembly 26 is deployed by conveyance 24 in the form of a wireline, but conveyance 24 may have other forms, including tubing strings, for other applications. In the illustrated embodiment, the packer assembly 26 is used to collect formation fluids from a surrounding formation 28. The packer assembly 26 is selectively expanded in a radially outward direction to seal across an expansion zone 30 with a surrounding wellbore wall 32, such as a surrounding casing or open wellbore wall. When the packer assembly 26 is expanded to seal against wellbore wall 32, formation fluids can be flowed into the packer assembly 26, as indicated by arrows 34. The formation fluids are then directed to a flowline, as represented by arrows 35, and produced to a collection location, such as a location at a well site surface 36. In other embodiments, the conveyance 24 may include two or more packer assemblies 26. For example, the conveyance may include two packer assemblies 26 (e.g., a dual packer assembly) and the formation fluids may flow into the conveyance 24 in between the two packer assemblies 26. As described in detail below, various embodiments of the packer assembly 26 (e.g., a single packer that collects formation fluids, a dual packer assembly that collects formations fluids between the two packers, and so forth) may include a retraction assembly to help retract the packer assembly 26 after deflating the packer assembly 26.

Figure 2:
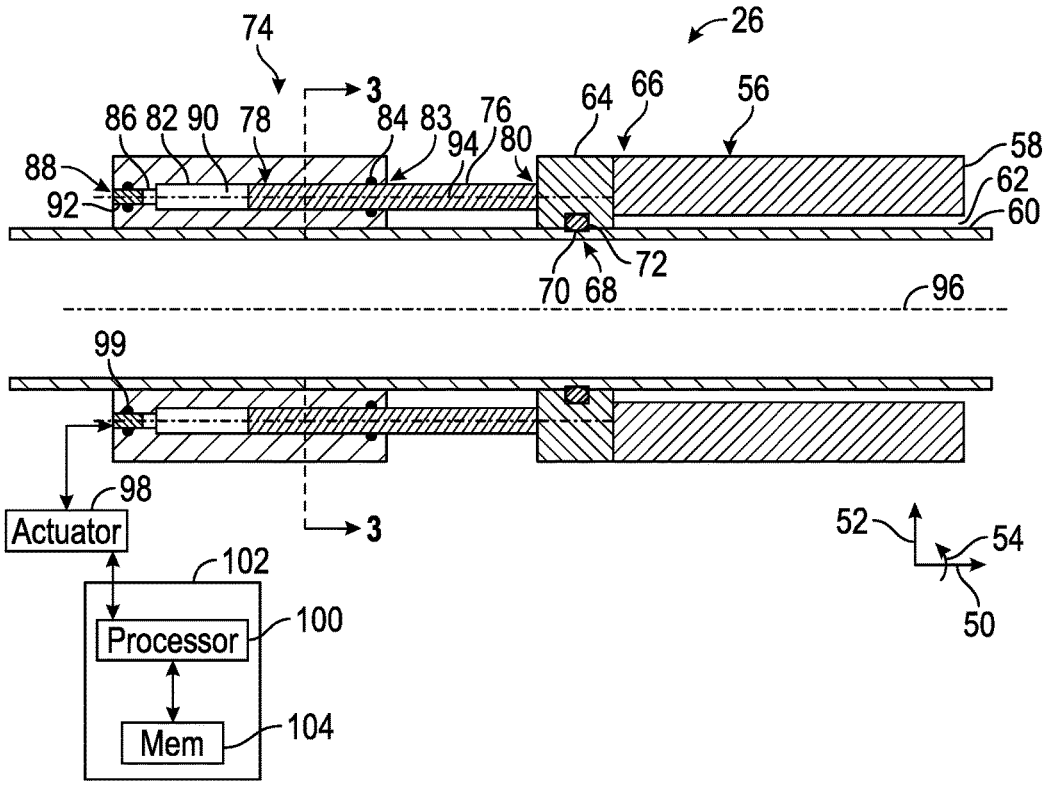
FIG. 2 is an axial cross-sectional view of a portion of a packer assembly according to an embodiment of the present disclosure.

FIG. 2 is an axial cross-sectional view of a portion of the packer assembly 26, which may have an axial axis or direction 50, a radial axis or direction 52, and a circumferential axis or direction 54. In this embodiment, packer assembly 26 includes an outer layer 56 (e.g., outer skin) that is expandable in the wellbore 22 to form a seal with surrounding wellbore wall 32 across expansion zone 30. The packer assembly 26 further includes an inner, inflatable bladder 58 disposed within an interior of outer layer 56. In one example, the inner bladder 58 (e.g., inner packer) is selectively expanded by fluid delivered via an inner mandrel 60 to an inner bladder chamber 62. In addition, an end support 64 is coupled to ends 66 of the outer skin 56 and the inner packer 58. The end support 64 may be slidingly engaged about the mandrel 60. In certain embodiments, the end support 64 may have an annular shape and be made from a metal or metal alloy. In some embodiments, the end support 64 may include an end support seal 68 to help block the exchange of fluid with the inner bladder chamber 62. Specifically, the end support seal 68 may help block fluid from moving from the inner bladder chamber 62, past the end support 64 along the mandrel 60, and into the wellbore 22. Various sealing techniques may be used for the end support seal 68, such as, but not limited to, O-rings, gaskets, packing, and so forth. In one embodiment, the end support seal 68 includes an end support O-ring 70 disposed in an end support groove 72 formed in a surface of the end support 64 facing toward the mandrel 60.

As shown in FIG. 2, the end support 64 may be coupled to a retraction assembly 74 via a plurality of connecting members 76, which may be made from various metals or metal alloys. In certain embodiments, the connecting members 76 may be cylindrical rods. The retraction assembly 74 is fixedly coupled to the mandrel 60. Each of the plurality of connecting members 76 may have a first end 78 and a second end 80. The second end 80 may be coupled to the end support 64. In certain embodiments, the plurality of connecting members 76 may be removably coupled to the end support 64. For example, the second end 80 may include a first threaded connection configured to engage a second threaded connection of the end support 64, which may facilitate the installation or removal of one or more of the plurality of connecting members 76. As described in more detail below, the number of connecting members 76 may affect the amount of retraction provided by the retraction assembly 74. For example, when the conditions of a particular wellbore 22 call for increased retraction, an operator may add additional connecting members 76 to the end support 64. Similarly, when the conditions of a particular wellbore 22 call for decreased retraction, the operator may remove some of the connecting members 76 from the end support 64. As discussed below, the addition or removal of the connecting members 76 may be made in pairs (e.g., 2 at a time). In further embodiments, the areas (e.g., cross-sectional areas) of the connecting members 76 may be adjusted to adjust the retraction forces. In particular, larger areas may result in larger retraction forces and smaller areas may result in smaller retraction forces. Thus, certain embodiments of the retraction assembly 74 may include a first set of connecting members 76 with a first area and a second set of connecting members 76 with a second area larger than the first area. When smaller retraction forces are desired, the first set of connecting members 76 may be used and when larger retraction forces are desired, the second set of connecting members 76 may be used. In yet further embodiments, the plurality of connecting members 76 may be fixedly coupled to the end support 64.

In the illustrated embodiment, the first ends 78 of the plurality of connecting members 76 are at least partially disposed within a plurality of chambers 82 disposed within the retraction assembly 74. Specifically, the first ends 78 may be inserted into first end openings 83 of the plurality of chambers 82. In certain embodiments, the retraction assembly 74 may have an annular shape (e.g., a ring) and be made from various metals or metal alloys. In addition, a cross-sectional shape and area of the chamber 82 may be approximately the same as the cross-sectional shape and area of the connecting member 76. For example, if the connecting member 76 has a circular cross-sectional shape, the chamber 82 may also have the same circular cross-sectional shape. Thus, the fit between the connecting member 76 and chamber 82 may have a relatively small clearance to help block the exchange of fluids between the plurality of chambers 82 and the wellbore 22. In some embodiments, the retraction assembly 74 may include a plurality of retraction assembly seals 84 to help block the exchange of fluid with the plurality of chambers 82. Various sealing techniques may be used for the retraction assembly seal 84, such as, but not limited to, O-rings, gaskets, packing, and so forth. During operation of the packer assembly 26, the plurality of connecting members 76 remain at least partially disposed within the plurality of chambers 82. In other words, the plurality of connecting members 76 are not intended to be removed from the plurality of chambers 82 during operation of the packer assembly 26, thereby maintaining the sealed integrity of the plurality of chambers 82.

As shown in FIG. 2, the retraction assembly 74 may include a plurality of ports 86 that are fluidly coupled to the plurality of chambers 82. Specifically, the plurality of ports 86 may couple to second end openings 88 of the retraction assembly 74 that are located opposite from the first end openings 83. The plurality of ports 86 are configured to enable the plurality of chambers 82 to be filled with a fluid 90 and/or enable adjustment of a pressure of the fluid 90 within the chambers 82. In certain embodiments, the fluid 90 includes a compressible fluid, such as nitrogen, air, oxygen, argon, methane, and so forth. Depending on the conditions of the wellbore 22, the initial pressures of the chambers 82 may be selected prior to inflating the inner packer 58 to adjust the resulting retraction forces. After the chamber 82 is filled with the fluid 90 or after the pressure of the fluid 90 is adjusted, a plug 92 may be inserted into the second end opening 88 to seal the port 86. The plug 92 may be threaded or other techniques may be used to fasten or restrain the plug 92 within the port 86. Thus, during operation of the retraction assembly 74, the fluid 90 is sealed within the plurality of chambers 82. As shown in FIG. 2, each connecting member 76, chamber 82, port 86, and plug 92 may be aligned along an axis 94. Further, the packer assembly 26 may have a packer axis 96. Both the axes 94 and 96 may be generally aligned with the axial axis 50 so that movement of the end support 64 and the plurality of connecting members 76 is in the axial 50 direction.

In certain embodiments, the pressure of the chambers 82 may be actively adjusted during use of the retraction assembly 74. For example, the plugs 92 may be coupled to an optional actuator 98 (e.g., a motor) configured to cause the plugs 92 to move in or out of the ports 86. In such embodiments, a plug seal 99 (e.g., O-ring) may be used to help prevent leakage between the chamber 82 and the wellbore while the plug 92 is moved within the port 86. An operator may want to change the retraction force exerted by the retraction assembly 74 while the packer assembly 26 is downhole in response to a change in wellbore conditions. Accordingly, the operator may send a signal to the actuator 98 so that the plugs 92 move out of the ports 86 (e.g., in a direction away from the chambers 82), thereby increasing the volume of the chambers 82, decreasing the pressure of the chambers 82, and increasing the retraction force. Further embodiments may employ other techniques for actively controlling the pressure within the chambers 82. In still further embodiments, the conveyance 24 may automatically adjust the actuator 98 in response to sensed wellbore conditions or other parameters without direct involvement of the operator. For example, the conveyance 24 may include a processor 100 of a control/monitoring system 102. In the context of the present disclosure, the term "processor" refers to any number of processor components. The processor 100 may include a single processor disposed onboard the conveyance 24. In other implementations, at least a portion of the processor 100 (e.g., where multiple processors collectively operate as the processor 100) may be located within the well system 20 of FIG. 1 and/or other surface equipment components. The processor 100 may also or instead be or include one or more processors located within the conveyance 24 and connected to one or more processors located in drilling and/or other equipment disposed at the wellsite surface. Moreover, various combinations of processors may be considered part of the processor 100. Similar terminology is applied with respect to the control/monitoring system 102, as well as a memory 104 of the control/monitoring system 102, meaning that the control/monitoring system 102 may include various processors communicatively coupled to each other and/or various memories at various locations.

Operation of the packer assembly 26 may include several steps. For example, after the packer assembly 26 is assembled and the plurality of chambers 82 are filled with the fluid 90, the packer assembly 26 may be positioned within the wellbore 22. The inner packer 58 is then inflated until the outer skin 56 seals against the wellbore wall 32. In particular, an inflating fluid enters the bladder chamber 62 to inflate the inner packer 58. As the inner packer 58 inflates and moves toward the wellbore wall 32, an axial 50 length of the inner packer 58 decreases, thereby causing the end support 64 coupled to the inner packer 58 to move in a first direction away from the retraction assembly 74. Accordingly, the plurality of connecting members 76 coupled to the end support 64 move in the first direction away from the retraction assembly 74, thereby increasing the volumes of the plurality of chambers 82. As the volumes of the plurality of chambers 82 increase, the pressure of the fluid 90 within the plurality of chambers 82 decreases because the plurality of chambers 82 are sealed closed by the plurality retraction assembly seals 84 and plugs 92. This decrease in pressure within the plurality of chambers 82 causes a retraction force to be exerted on the plurality of connecting members 76 in a second direction opposite from the first direction. The retraction force may be approximately equal to a net pressure (e.g., hydrostatic pressure within the wellbore 22 minus the pressure within the chamber 82) multiplied by the area of the connecting member 76 minus any losses caused by friction (e.g., friction between the connecting member 76 and the retraction assembly seal 84 and/or walls of the chamber 82). However, the inflating force exerted by the flow of fluid into the bladder chamber 62 may be greater than the retraction force so that the inner packer 58 is inflated until the outer skin 56 seals against the wellbore wall 32. Various downhole operations may be conducted while the packer assembly 26 is inflated such as, but not limited to, sampling, pressure drawdown, sensing, fluid injection, fracturing, and so forth.

After the downhole operations are complete, the inner packer 58 may be deflated by withdrawing the inflating fluid from the bladder chamber 62. As the inner packer 58 deflates, the inner packer 58 may move away from the wellbore wall 32 and the axial 50 length of the inner packer 58 may increase, thereby causing the end support 64 to move in the second direction toward the retraction assembly 74. However, in certain situations, the inner packer 58 may not return completely to its original position prior to inflation even after withdrawal of the inflating fluid. Accordingly, the retraction assembly 74 may help retract the inner packer 58 and outer skin 56 completely or fully to approximately the original, uninflated position. Specifically, the retraction force may help move the plurality of connecting members 76 to their original position such that the volumes of the plurality of chambers 82 return to their original volumes, thereby returning the end support 64 to its original position. The process of inflating the inner packer 58, deflating the inner packer 58, and retracting the inner packer 58 via the retraction assembly 74 may then be repeated at another position within the wellbore 22.

In certain embodiments, the packer assembly 26 may include two retraction assemblies 74 located an opposite ends of the inner packer 58. In other words, separate retraction assemblies 74 are provided at both ends of the inner packer 58 because both ends of the inner packer 58 move during inflation. In other embodiments, the packer assembly 26 may include one retraction assembly 74 located at one end of the inner packer 58 that is configured to move during inflation. In such embodiments, an opposite end of the inner packer 58 may be fixedly coupled to the mandrel or otherwise fixed so that the opposite end does not move. Thus, one retraction assembly 74 is provided for the one end that moves during inflation.

Figure 3:
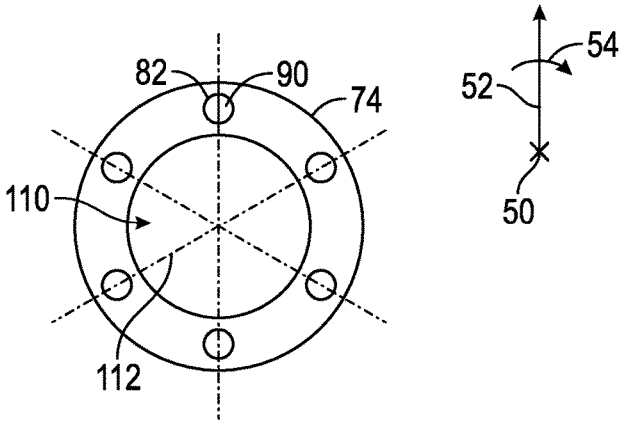
FIG. 3 is a radial cross-sectional view of a retraction assembly of a packer assembly according to an embodiment of the present disclosure.

FIG. 3 is a radial cross-sectional view of the retraction assembly 74 of the packer assembly 26 taken along line 3-3 of FIG. 2. As shown in FIG. 3, the retraction assembly 74 has an annular shape with a circular opening 110 to enable the retraction assembly 74 to be installed about the mandrel 60. In other embodiments in which the mandrel 60 has a different cross-sectional shape, the opening 110 of the retraction assembly 74 may have a corresponding cross-sectional shape to substantially match the mandrel 60. As discussed above, the retraction assembly 74 is fixedly coupled to the mandrel 60 using a variety of techniques, such as, but not limited to, welding, brazing, threaded connections, and so forth. As shown in FIG. 3, each of the plurality of chambers 82 has a circular cross-sectional shape that substantially matches a circular cross-sectional shape of the plurality of connecting members 76. In further embodiments, both the plurality of chambers 82 and plurality of connecting members 76 may have other cross-sectional shapes, such as, but not limited to, ovals, squares, triangles, rectangles, polygons, slots, arcs, and so forth. In the illustrated embodiment, the plurality of chambers 82 are disposed in pairs aligned along axes 112 and the pairs of chambers 82 are approximately evenly distributed about the retraction assembly 74. For example, the six chambers 82 shown in FIG. 3 are spaced approximately 60 degrees apart from one another. Placement of the plurality of chambers 82 in evenly distributed pairs enables the retraction force exerted on the end support 64 to be evenly distributed. In further embodiments, the retraction assembly 74 may include 2, 4, 8, 10, 12, 14, or more chambers 82. Addition or removal of the connecting members 76 may be made in pairs so the retraction forces are evenly distributed across the end support 64.

Figure 4:
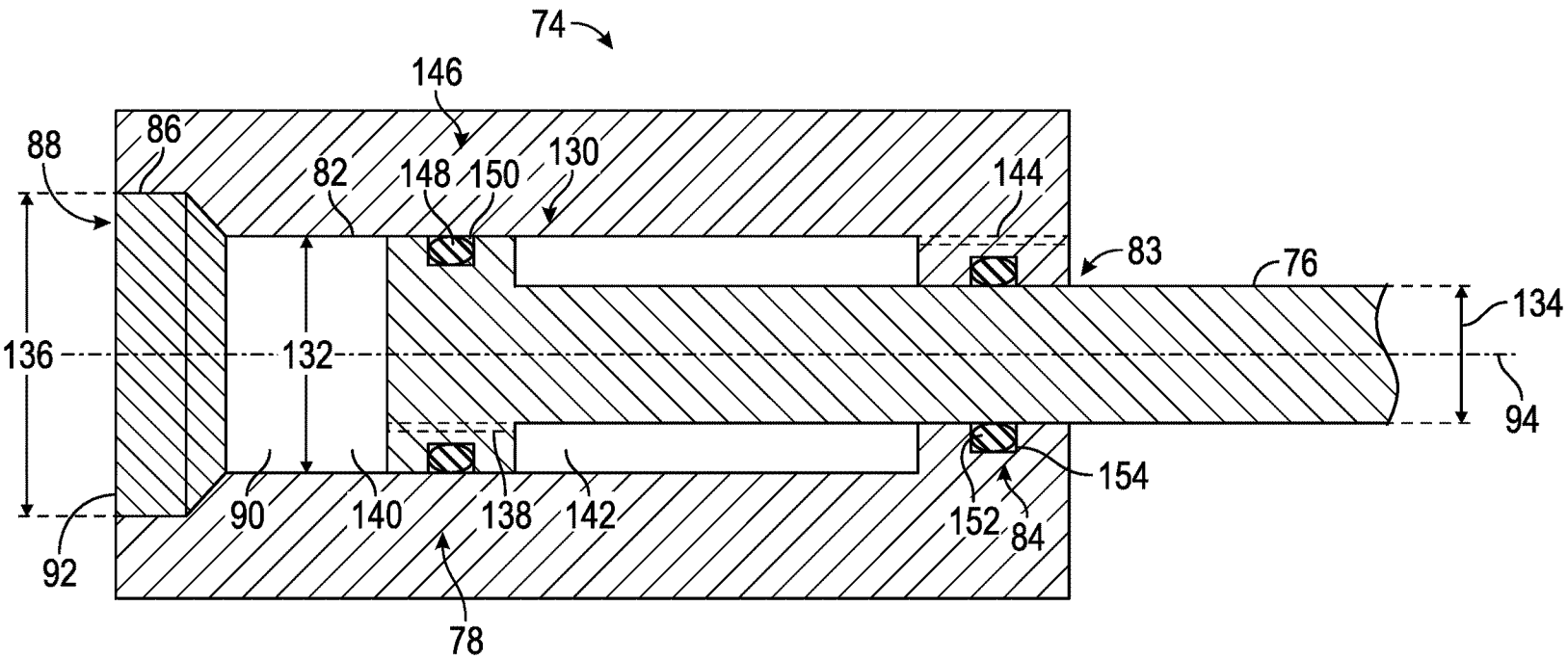
FIG. 4 is an axial cross-sectional view of a retraction assembly having a stop according to an embodiment of the present disclosure.

FIG. 4 is an axial cross-sectional view of a portion of the retraction assembly 74 having a stop 130. As discussed above, the plurality of connecting members 76 are not intended to be completely withdrawn from the plurality of chambers 82 during operation of the retraction assembly 76 to maintain the sealed integrity of the plurality of chambers 82. Certain embodiments of the retraction assembly 74 may include the plurality of stops 130 to help retain the plurality of connecting members 76 within the plurality of chambers 82 during operation of the retraction assembly 76. In other words, the stops 130 block the connecting members 74 from being withdrawn from the first ends 83 of the chambers 82. In the illustrated embodiment, the connecting members 76 may be inserted into the chambers 82 through the second end openings 88 during assembly of the retraction assembly 74. In contrast, the connecting members 76 shown in FIG. 2 may be inserted into the chambers 82 through the first end openings 83 during assembly of the retraction assembly 74. The reason the connecting members 76 of the embodiment shown in FIG. 4 are inserted through the second end openings 88 is that first end areas (or diameters 132) of the first ends 78 of the connecting members 76 are larger than the first end openings 83 (or diameters 134 of the first end opening 83). Accordingly, the second end openings 88 (or diameters 136 of the second end openings 88) are approximately equal to or greater than the first end areas (or diameters 132) of the connecting members 76. During operation, the connecting members 76 cannot be withdrawn through the first end openings 83 because the first end areas (or diameters 132) of the first ends 78 are larger than the first end openings 83 (or diameters 134 of the first end opening 83).

In certain embodiments, the first ends 78 of the connecting members 76 may include one or more optional ports 138 to enable the fluid 90 to move from a first portion 140 of the chamber 82 to a second portion 142 of the chamber 82 during operation of the retraction assembly 74. Use of the one or more ports 138 may help prevent fluid 90 located in the second portion 142 from increasing in pressure during movement of the connecting members 76 away from the retraction assembly 74 caused by a decrease in volume of the section portion 142, which may possibly cancel out or partially reduce the retraction force developed by the increase in volume of the first portion 140. During movement of the connecting members 76 away from the retraction assembly 74, the total volume of the chambers 82 (e.g., sum of first and second portions 140 and 142) increases, thereby creating the retraction forces when the fluid 90 is free to move through the one or more ports 138.

In further embodiments, the retraction assembly 74 may include one or more optional ports 144 to enable fluid to move in and out of the second portion 142 of the chambers 82 during operation of the retraction assembly 74. Use of the one or more ports 144 may help prevent fluid located in the second portion 142 from increasing in pressure during movement of the connecting members 76 away from the retraction assembly 74 caused by a decrease in volume of the section portion 142, which may possibly cancel out or partially reduce the retraction force developed by the increase in volume of the first portion 140. During movement of the connecting members 76 away from the retraction assembly 74, the volume of the first portion 140 of the chambers 82 increases, thereby creating the retraction forces. In such embodiments, a first end seal 146 may be provided in the first ends 78 of the connecting members 76 to help block fluid from moving between the first and second portions 140 and 142 of the chambers 82. Various sealing techniques may be used for the first end seal 146, such as, but not limited to, O-rings, gaskets, packing, and so forth. In one embodiment, the first end seal 146 includes a first end seal O-ring 148 disposed in a first end seal groove 150.

The embodiment illustrated in FIG. 4 shows further details regarding the retraction assembly seals 84. In particular, the retraction assembly seals 84 may include a retraction assembly O-ring 152 disposed in a retraction assembly groove 154. The retraction assembly seals 84 may be omitted when the retraction assembly 74 includes the one or more ports 144.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A downhole packer assembly, comprising:

an outer skin;

an inner packer disposed within the outer skin such that inflation of the inner packer is configured to expand the outer skin;

an end support coupled to an outer skin end and an inner packer end;

a retraction assembly coupled to the end support via a plurality of connecting members; and a plurality of chambers disposed within the retraction assembly, wherein the plurality of connecting members are at least partially disposed within the plurality of chambers;

wherein the end support comprises an end support seal configured to block exchange of fluids with an inner bladder chamber, and the retraction assembly comprises a plurality of retraction assembly seals configured to block exchange of fluids with the plurality of chambers;

a plurality of ports disposed within the retraction assembly and fluidly coupled to the plurality of chambers, wherein the plurality of ports are configured to enable adjustment of pressures within the plurality of chambers; and a plurality of plugs disposed within the plurality of ports, wherein the plurality of plugs are configured to seal the plurality of chambers after adjustment of the pressures within the plurality of chambers.

2. The downhole packer assembly of claim 1, wherein the retraction assembly comprises a ring and the plurality of chambers are formed within the ring.

3. The downhole packer assembly of claim 1, wherein the plurality of connecting members comprise cylindrical rods.

4. The downhole packer assembly of claim 1, wherein the plurality of connecting members are removably coupled to the end support.

5. The downhole packer assembly of claim 1, wherein the retraction assembly is configured to retract the end support in an axial direction along an axis of the downhole packer assembly.

6. The downhole packer assembly of claim 1, comprising a plurality of stops disposed within the plurality of chambers, wherein the plurality of stops are configured to block the plurality of connecting members from being withdrawn from the plurality of chambers in a direction toward the end support.

7. The downhole packer assembly of claim 1, comprising a mandrel, wherein the retraction assembly is fixedly coupled to the mandrel and the end support is slidingly engaged about the mandrel.

8. The downhole packer assembly of claim 1, wherein the downhole packer assembly is configured for conveyance within a wellbore by at least one of a wireline or a drillstring.

9. A method, comprising:

providing a packer assembly having an inner packer disposed within an outer skin, an end support coupled to an outer skin end and an inner packer end, a retraction assembly coupled to the end support via a plurality of connecting members, and a plurality of chambers disposed within the retraction assembly, wherein the plurality of connecting members are at least partially disposed within the plurality of chambers;

positioning the packer assembly in a wellbore;

inflating the inner packer until the outer skin seals against walls of the wellbore, wherein inflating comprises moving the end support in a first direction such that volumes of the plurality of chambers increase thereby exerting retraction forces on the plurality of connecting members;

deflating the inner packer; and retracting the outer skin and the inner packer using the retraction assembly, wherein retracting comprises moving the end support in a second direction opposite from the first direction via the retraction forces such that volumes of the plurality of chambers decrease.

10. The method of claim 9, comprising adjusting at least one of the plurality of connecting members to adjust a total of the retraction forces.

11. The method of claim 9, comprising adjusting an area of the plurality of connecting members to adjust a total of the retraction forces.

12. The method of claim 9, comprising adjusting initial pressures of the plurality of chambers prior to inflating the inner packer to adjust retraction forces exerted on the plurality of connecting members.

13. The method of claim 9, comprising filling the plurality of chambers with compressible fluid prior to inflating the inner packer.

14. A downhole packer assembly, comprising:

an outer skin;

an inner packer disposed within the outer skin such that inflation of the inner packer is configured to expand the outer skin;

an end support coupled to an outer skin end and an inner packer end;

a retraction assembly coupled to the end support via a plurality of connecting members;

a plurality of chambers disposed within the retraction assembly, wherein the plurality of connecting members are at least partially disposed within the plurality of chambers;

a plurality of ports disposed within the retraction assembly and fluidly coupled to the plurality of chambers, wherein the plurality of ports are configured to enable adjustment of pressures within the plurality of chambers; and a plurality of plugs disposed within the plurality of ports, wherein the plurality of plugs are configured to seal the plurality of chambers after adjustment of the pressures within the plurality of chambers.

* * * * *